US009738476B2

(12) United States Patent
Klerelid et al.

(10) Patent No.: US 9,738,476 B2
(45) Date of Patent: Aug. 22, 2017

(54) REEL-UP FOR WINDING A PAPER WEB INTO A ROLL AND A METHOD OF WINDING A PAPER WEB TO FORM A ROLL

(71) Applicant: Valmet Aktiebolag, Sundsvall (SE)

(72) Inventors: Ingvar Klerelid, Karlstad (SE); Per-Olof Malmqvist, Karlstad (SE)

(73) Assignee: VALMET AKTIEBOLAG, Sundsvall (SE)

( * ) Notice: Subject to any disclaimer, the term of this patent is extended or adjusted under 35 U.S.C. 154(b) by 0 days.

(21) Appl. No.: 14/774,991

(22) PCT Filed: Apr. 15, 2014

(86) PCT No.: PCT/SE2014/050468
§ 371 (c)(1),
(2) Date: Sep. 11, 2015

(87) PCT Pub. No.: WO2014/175808
PCT Pub. Date: Oct. 30, 2014

(65) Prior Publication Data

US 2016/0031667 A1 Feb. 4, 2016

(30) Foreign Application Priority Data

Apr. 26, 2013 (SE) ..... 1350519

(51) Int. Cl.
*B65H 18/22* (2006.01)
*B65H 20/06* (2006.01)
(Continued)

(52) U.S. Cl.
CPC ..... *B65H 18/22* (2013.01); *B65H 20/06* (2013.01); *D21F 7/00* (2013.01); *D21H 25/10* (2013.01);
(Continued)

(58) Field of Classification Search
CPC ..... D21F 1/0072; D21F 7/00; B65H 2801/84; B65H 18/22; B65H 20/06;
(Continued)

(56) References Cited

U.S. PATENT DOCUMENTS 3,743,199 A 7/1973 Karr et al.
4,420,529 A * 12/1983 Westhead ..... D03D 15/0005 139/383 A
(Continued)

FOREIGN PATENT DOCUMENTS

CN 1129023 A 8/1996
CN 1261856 A 8/2000
(Continued)

OTHER PUBLICATIONS

The State Intellectual Property Office of the People's Republic of China, First Notification of Office Action for Application No. 201480023160.6, dated May 3, 2016, 18 pages, P.R.C.
(Continued)

*Primary Examiner* — Jose Fortuna
(74) *Attorney, Agent, or Firm* — Alston & Bird LLP

(57) ABSTRACT

The invention relates to a reel-up (2) for receiving and winding into a roll (3) a paper web (W) that arrives from a drying cylinder (17) in a paper making machine (1). The reel-up (2) comprises a rotatably mounted reel spool (4) onto which a paper web (W) can be wound to create a paper roll (3) of increasing diameter and an endless flexible belt (5) mounted for rotation along a predetermined path of travel such that the flexible belt (5) forms a loop. The flexible belt (5) is positioned adjacent to the reel spool (4) to engage the paper web (W) against the reel spool (4) during winding such that the flexible belt (5) is deflected from the predetermined path of travel. According to the invention, the endless flexible belt (5) comprises electrically conductive material such that static electricity in the flexible belt (5) is dissipated away from the flexible belt (5). The invention also
(Continued)

relates to a paper making machine in which the inventive reel-up is used and to a method of winding a paper web.

8 Claims, 7 Drawing Sheets

(51) Int. Cl.
*D21F 7/00* (2006.01)
*D21H 25/10* (2006.01)

(52) U.S. Cl.
CPC ..... *B65H 2301/4143* (2013.01); *B65H 2301/5133* (2013.01); *B65H 2301/5321* (2013.01); *B65H 2401/141* (2013.01); *B65H 2401/211* (2013.01); *B65H 2404/271* (2013.01); *B65H 2404/5331* (2013.01); *B65H 2515/716* (2013.01); *B65H 2801/84* (2013.01)

(58) Field of Classification Search
CPC .... B65H 2301/4143; B65H 2301/5133; B65H 2404/271; D10B 2401/16; B31F 1/122; B31F 1/14; D21H 25/10; Y10S 162/902; D03D 15/00; D03D 15/0005; B65G 15/54
See application file for complete search history.

(56) References Cited

U.S. PATENT DOCUMENTS 4,523,252 A * 6/1985 Wallen ..... H02H 9/04 361/212
4,649,074 A * 3/1987 Borel ..... D21F 1/0072 28/104
5,014,924 A 5/1991 Nowisch et al.
5,183,442 A * 2/1993 Lefferts ..... B29C 53/12 156/425
5,244,721 A * 9/1993 Wyche ..... B32B 27/18 162/123
5,251,835 A 10/1993 Kyytsonen
5,360,179 A 11/1994 Vesterinen et al.
5,404,653 A 4/1995 Skaugen et al.
5,514,456 A * 5/1996 Lefferts ..... D21F 1/0072 139/383 A
5,531,396 A 7/1996 Kinnunen et al.
5,738,760 A 4/1998 Svanqvist et al.
5,782,426 A 7/1998 Kinnunen et al.
5,901,918 A 5/1999 Klerelid et al.
6,695,245 B1 2/2004 Schultz et al.
6,698,681 B1 3/2004 Guy et al.
6,743,334 B2 * 6/2004 Klerelid ..... B65H 19/28 162/118
6,790,796 B2 9/2004 Smith et al.
6,797,115 B2 * 9/2004 Klerelid ..... B31F 1/122 162/111
6,805,317 B1 10/2004 Andersson et al.
6,998,018 B2 * 2/2006 Klerelid ..... B31F 1/122 162/111
7,112,258 B2 * 9/2006 Klerelid ..... B65H 19/28 162/109
7,398,943 B2 7/2008 Horneck et al.
7,604,715 B2 * 10/2009 Liesen ..... D21H 23/16 162/158
7,651,728 B2 * 1/2010 Payne ..... D21F 1/0054 427/207.1
7,896,034 B2 * 3/2011 Harwood ..... D03D 1/0023 139/383 A
8,167,229 B2 * 5/2012 Enwald ..... B65H 19/265 242/527
8,871,060 B2 * 10/2014 Klerelid ..... D21F 11/006 162/217
2002/0139499 A1 10/2002 Berglund et al.
2003/0068948 A1 4/2003 Smith et al.
2003/0164199 A1 9/2003 Levine et al.
2003/0221807 A1 * 12/2003 Klerelid ..... B31F 1/122 162/111
2006/0076116 A1 4/2006 Klerelid et al.
2006/0124268 A1 * 6/2006 Billings ..... D21F 1/0072 162/348
2006/0289692 A1 12/2006 Horneck et al.
2007/0003729 A1 * 1/2007 Harwood ..... D21F 1/0072 428/58
2007/0023561 A1 2/2007 Kemppainen et al.
2007/0075178 A1 4/2007 Hada et al.
2008/0050587 A1 * 2/2008 Billings ..... D21F 1/0072 428/373
2008/0131652 A1 * 6/2008 Payne ..... D21F 1/0054 428/99
2008/0135195 A1 * 6/2008 Hermans ..... D21H 21/18 162/135
2008/0318483 A1 * 12/2008 Salitsky ..... D01F 8/00 442/6
2010/0051736 A1 * 3/2010 Enwald ..... B65H 19/265 242/527
2010/0236656 A1 * 9/2010 Harwood ..... D03D 1/0023 139/383 R
2011/0146913 A1 * 6/2011 Harwood ..... D21F 1/0036 156/379.6
2011/0151735 A1 * 6/2011 Harwood ..... B31F 1/2881 442/101
2012/0024487 A1 * 2/2012 Quigley ..... D21F 1/0027 162/116
2012/0024489 A1 * 2/2012 Quigley ..... D21F 1/0027 162/289
2012/0267063 A1 * 10/2012 Klerelid ..... D21F 11/006 162/130
2014/0130997 A1 * 5/2014 Klerelid ..... D21F 11/006 162/217
2016/0016745 A1 * 1/2016 Malmqvist ..... B65H 20/06 242/535.4
2016/0031667 A1 * 2/2016 Klerelid ..... B65H 20/06 162/111
2016/0185548 A1 * 6/2016 Malmqvist ..... B65H 19/265 242/526.3
2016/0251187 A1 * 9/2016 Malmqvist ..... B65H 20/06 242/535.4

FOREIGN PATENT DOCUMENTS

CN 150058 A 5/2004
CN 01578858 A 2/2005
CN 101981252 A 2/2011
CN 102121167 A 7/2011
CN 102182097 A 9/2011
DE 10305606 A1 8/2004
DE 102007055761 A1 * 6/2009 ..... D21F 1/0072
DE EP 2354299 A1 * 8/2011 ..... D21F 1/0036
EP 0658504 A2 6/1995
EP 1741648 A2 1/2007
GB 2423998 A 9/2006
JP 200125336 A 8/2001
KR 101266781 B1 * 5/2013 ..... D21F 1/0036
SE EP 1538259 A2 * 6/2005 ..... B65H 19/28
SE WO 2008125723 A1 * 10/2008 ..... B65H 19/265
SE WO 2014175808 A1 * 10/2014 ..... B65H 20/06
WO WO 97/48632 A1 12/1997
WO WO 99/01363 A1 1/1999
WO WO 03/031711 A1 4/2003
WO WO 2008/157223 A1 12/2008
WO WO 2008154214 A1 * 12/2008 ..... D01F 8/00
WO WO 2009/118450 A1 10/2009
WO WO 2013/113110 A1 8/2013
WO WO 2014/158071 A1 10/2014
WO WO 2015/034413 A1 3/2015

OTHER PUBLICATIONS

International Searching Authority, International Search Report and Written Opinion for International Application No. PCT/SE2014/

(56) References Cited

OTHER PUBLICATIONS 050468, dated Jun. 26, 2014, 8 pages, Swedish Patent and Registration Office, Stockholm.
European Patent Office, Extended European Search Report for Application No. 14787495.2, dated Nov. 29, 2016, 7 pages, Germany.

* cited by examiner

REEL-UP FOR WINDING A PAPER WEB INTO A ROLL AND A METHOD OF WINDING A PAPER WEB TO FORM A ROLL

CROSS REFERENCE TO RELATED APPLICATIONS

This application is a National Stage Application, filed under 35 U.S.C. §371, of International Application No. PCT/SE2014/050468 filed Apr. 15, 2014, which claims priority to Swedish Patent Application No. 1350519-3, filed Apr. 26, 2013, the contents of both of which are hereby incorporated by reference in their entirety.

BACKGROUND

Related Field

The present invention relates to a reel-up for winding a paper web into a roll and to a method of winding a paper web to form a roll.

Description of Related Art

In a paper making machine, the ready-dried web is brought to a reel-up and wound on a reel spool to a roll of paper. This is often made in a Pope-type reel-up in which the paper web rests on and is driven by a supporting cylinder whose peripheral speed is equal to that of the paper web. Examples of such a Pope-type reel-up are disclosed in, for example, U.S. Pat. Nos. 3,743,199 and 5,251,835. In such reel-ups, the paper roll forms a nip with the supporting cylinder and a load is applied in the nip. In order to ensure that the paper roll being formed is substantially uniform, the nip pressure should be controlled. When nip pressure cannot be sufficiently controlled, this may result in paper rolls in which the paper has not been uniformly wound. This may also affect the paper properties. Especially tissue paper webs may be particularly sensitive to this problem.

To ensure a uniform winding, it has been suggested in for example U.S. Pat. No. 5,901,918 that the supporting cylinder be replaced by a flexible member such as a belt such that the paper web is engaged by the flexible member against the reel spool during winding.

In a reel-up of the kind disclosed in U.S. Pat. No. 5,901,918, i.e. a reel-up in which a flexible member such as a belt is used, it is of importance that the paper web adheres properly to the belt such that it does not become destabilized which could lead to wandering or wrinkles in the web. At the same time, the web should not adhere too strongly to the belt since that could lead to difficulties in transferring the paper web to the reel spool. To ensure a proper degree of adherence of the web to the belt, it has been suggested in U.S. Pat. No. 7,398,943 that the static electricity of at least one of the belt and the paper web be measured by a static measurement probe and that at least one static induction device be used. The static induction device should then be used for inducing a static charge into at least one of the endless flexible belt and the paper web. According to the '943 patent, the static charge difference between the web and the belt should be at least 6 kV or more in order to avoid poor web handling. However, the '943 patent also states that the static charge difference should be kept below 20 kV in order to avoid difficulties in connection with web transfer from the belt to the reel spool.

The object of the present invention is to provide a belt reel-up belt with improved control of the adherence of the paper web to the belt such that winding can be carried out in a controlled way.

BRIEF SUMMARY

The object of the invention is achieved by the inventive reel-up for receiving and winding into a roll a paper web that arrives from a drying cylinder in a paper making machine. The inventive reel-up comprises a rotatably mounted reel spool onto which a paper web can be wound to create a paper roll of increasing diameter and an endless flexible belt mounted for rotation along a predetermined path of travel such that the flexible belt forms a loop. The flexible belt is positioned adjacent to the reel spool to engage the paper web against the reel spool during winding such that the flexible belt is deflected from the predetermined path of travel when a paper roll is formed on the reel spool. In principle, the flexible belt will be deflected by an amount relative to the amount of paper material wound on the reel spool but the deflection can be kept constant or kept within predetermined limits if the distance between the reel spool and the predetermined path of the belt is increased as the diameter of the paper roll grows.

According to the invention, the endless flexible belt comprises electrically conductive material such that static electricity in the flexible belt is dissipated away from the flexible belt.

In an embodiment of the invention, the flexible belt is a woven fabric which is permeable to air and has a plurality of warp yarns and a plurality of weft yarns interwoven with the plurality of warp yarns and wherein at least some of the yarns are electrically conductive and preferably at least some of the weft yarns are electrically conductive.

In yet another embodiment of the invention, the flexible belt is a spiral link belt which is permeable to air and which comprises electrically conductive elements that have been inserted into the spiral link belt and extend in a cross-machine direction.

In advantageous embodiments of the invention, the reel-up further comprises: a deflection sensor mounted adjacent to the flexible belt and being arranged to measure the amount of deflection of the flexible belt from the predetermined path of travel; an actuator for positioning the reel spool and the flexible belt relative to each other to vary the amount of deflection of the flexible belt; and a controller connected to the deflection sensor and the actuator for controlling the amount of deflection of the flexible belt as the paper roll increases in diameter.

In embodiments using a flexible belt that is permeable to air, the reel-up may further comprise at least one source of underpressure located inside the loop of the flexible belt.

The invention may be used in, for example, a paper making machine for making tissue paper and which comprises a Yankee drying cylinder and a doctor blade arranged to crepe a paper web from the surface of the Yankee drying cylinder, and wherein, downstream of the Yankee drying cylinder, the paper making machine further comprises a reel-up according to the invention.

The invention also relates to a method of winding a paper web to form a roll. The inventive method comprises the steps of: engaging an endless flexible belt against a reel spool; moving the endless flexible belt along a predetermined path of travel; rotating the reel spool such that the surface of the reel spool moves together with the flexible belt and forms a nip with the flexible belt; and advancing the paper web into the nip and directing the web around the reel spool to form a roll of increasing diameter. In the inventive method, the endless flexible belt is a belt that comprises electrically conductive material such that static electricity in the endless flexible belt is dissipated away from the endless flexible belt.

In embodiments of the inventive method, the paper web is first creped from a Yankee drying cylinder and subsequently conveyed to the endless flexible belt to be wound to a roll.

BRIEF DESCRIPTION OF THE FIGURES

FIG. 1 is a schematic side view of a part of a reel-up of the type that the present invention relates to.

DETAILED DESCRIPTION OF VARIOUS EMBODIMENTS

Figure 1:
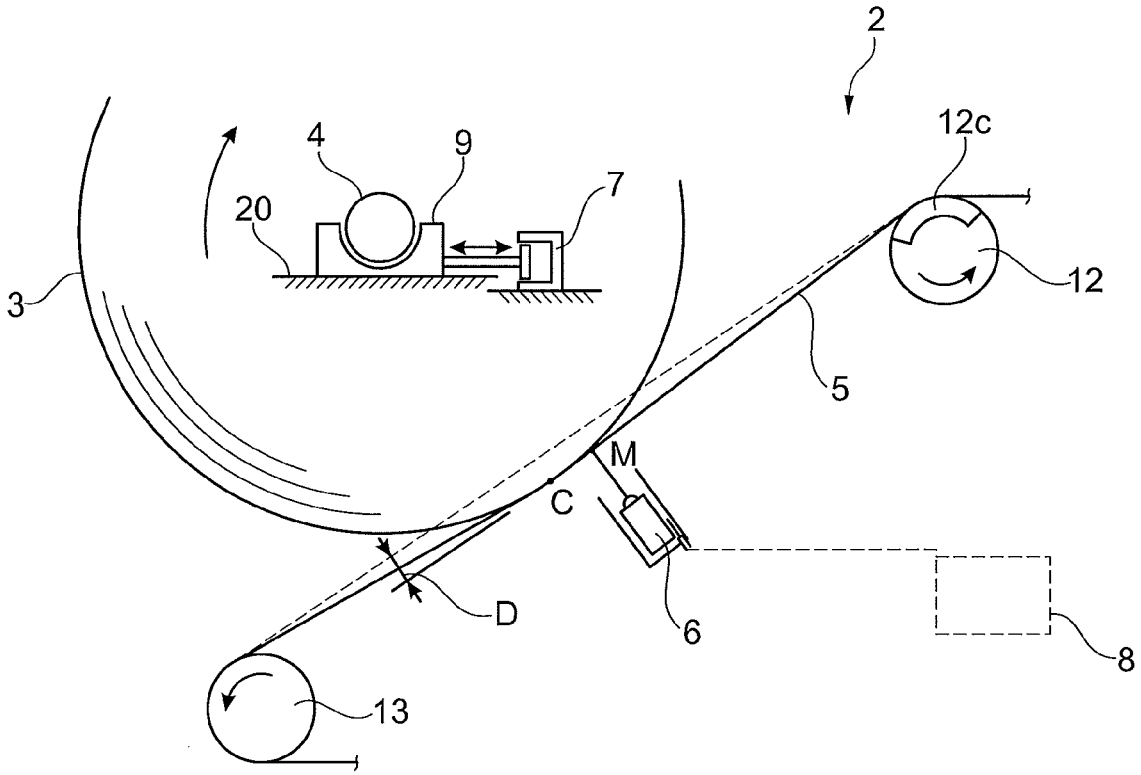
Figure 2:
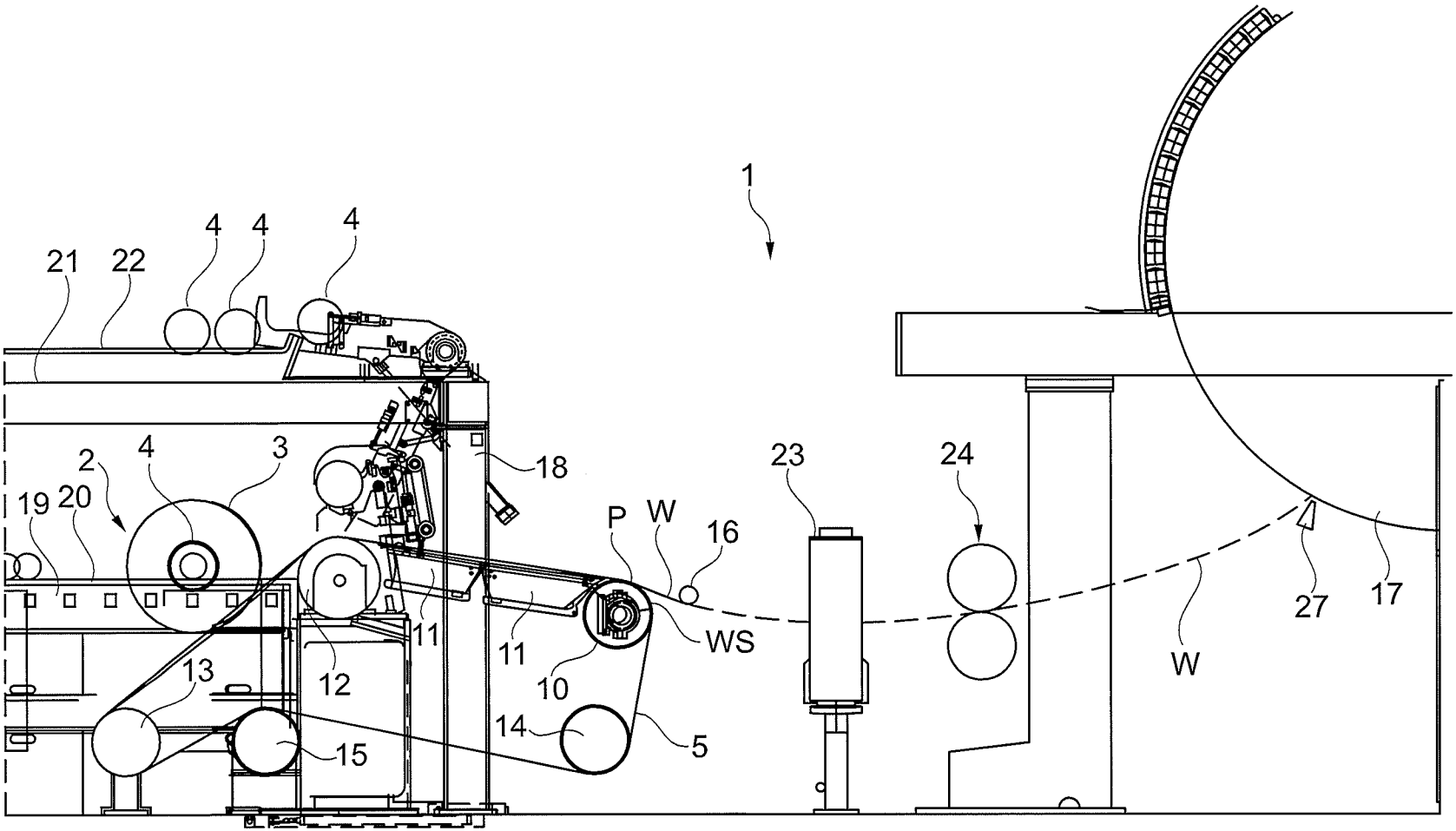
FIG. 2 is a side view of a reel-up placed in the dry end of a paper making machine

With reference to FIG. 1 and to FIG. 2, a reel-up 2 is shown which is arranged for receiving and winding into a roll 3 a paper web W that arrives from a drying cylinder 17 in a paper making machine. The reel-up 2 is a belt reel 2 that comprises a rotatably mounted reel spool 4 onto which a paper web W can be wound to create a paper roll 3 of increasing diameter and an endless flexible belt 5 mounted for rotation along a predetermined path of travel such that the flexible belt 5 forms a loop. The flexible belt 5 is positioned adjacent to the reel spool 4 to engage the paper web W against the reel spool 4 during winding such that the flexible belt 5 is deflected from the predetermined path of travel when a paper roll 3 is formed, i.e. when the paper roll 3 starts to build up on the reel spool 4. Of course, once the web W has started to become wound on the reel spool 4 and form a paper roll 3 on the reel spool 4, new paper web that arrives will be engaged against the reel spool 4 through the paper roll 3 that is being formed on the reel spool 4. In the context of this patent application and any patent granted on this patent application, the expression "engage the web against the reel spool" should thus be understood as including the case where the web that arrives to the nip point C is engaged by the flexible belt 5 against the paper roll 3 that is wound on the reel spool 4. New paper web that arrives to the nip point C is engaged against the reel spool 4 and any paper roll 3 already formed on the reel spool 4. In order for the paper web W to have the correct degree of adhesion to the flexible belt 5, it has previously been suggested in U.S. Pat. No. 7,398,943 that static electricity of at least one of the belt and the paper web be measured by a static measurement probe and that one or several static induction devices be used and that the static charge difference between the web and the belt should be kept in the range of 6 kV-20 kV. Such a method may achieve its purpose but the inventors have found that the previously known method is not optimal for achieving a correct degree of adherence of the paper web W to the flexible belt 5.

The operation becomes dependent on the reliability of the measurement probe and the induction device or induction devices. One problem is that the static electricity in the flexible belt 5 and/or paper web W may lead to uncontrolled electric discharges that disturb the operation of the measurement probe and/or the static induction device(s). Moreover, if the reeling is carried out in an environment with large amounts of dust in the air, this may also disturb the operation of the measurement probe and the induction device or induction devices. In particular in such cases where the paper web W has been creped from a drying cylinder, for example a Yankee drying cylinder, there may be large amounts of dust in the air since the creping operation generates large quantities of dust that fill the air in the dry end of the machine where the reel 2 is located. Even without a static induction device, the belt may become charged with static electricity due to friction between the belt and guide rolls that are used to guide the belt in its loop but the actual level of the static electricity may vary considerably which can lead to variations in the adherence of the paper web to the belt. The inventors have found that, generally, more static electricity seems to be generated due to friction when the dryness level of the paper web is high. In particular, the inventors have noted that much static electricity is generated when the moisture content of the web that arrives to the reel-up is no more than 3% by weight but the actual level or amount of static electricity can be difficult to predict. This is in particular the case for production of high bulk tissue products on for example TAD machines. The difficulties may be further aggravated by the fact that static electricity and dust disturb the function of measurement probes and induction devices. The actual charge difference between the web W and the flexible belt 5 can therefore vary in ways that are difficult to predict and the control of the charge difference may be less than satisfactory.

Therefore, the inventors have found that the paper web W should be made to adhere correctly to the belt without relying on measurement probes for static electricity and/or static induction devices.

Instead of static induction devices, the present invention uses an endless flexible belt 5 that comprises electrically conductive material such that static electricity in the flexible belt 5 is dissipated away from the flexible belt 5. In this way, static electricity can be dissipated away from the flexible belt and the paper web. As a consequence, the level of the static charge will be low or zero and can be disregarded. This means that static charge is predictable (since it is zero or too small to be of significance) and that there will be no substantial variations in the static charge that could lead to variations in the adherence of the paper web W to the flexible belt 5.

Instead of achieving adherence by means of a difference in static charge, adherence of the paper web to the flexible belt should be achieved by means that are not dependent on electronic equipment that can be disturbed by static electricity in the flexible belt or the paper web. One solution may be to use a flexible belt 5 which is substantially impermeable and has a smooth surface that the paper web W adheres to the flexible belt 5 due to the smooth surface of the flexible belt 5. In the smooth surface of the flexible belt 5, electrically conductive material may be placed. For example, if the flexible belt 5 is a polyurethane belt, thin electrically conductive wires may be embedded in the surface of the smooth flexible belt.

However, in preferred embodiments of the invention, the endless flexible belt 5 is a belt which is permeable to air. Such a solution is advantageous since the adherence of the paper web W can then be reliably kept on a proper level by means of suction devices arranged inside the loop of the flexible belt 5 which can be operated based on practical experience.

Figure 6:
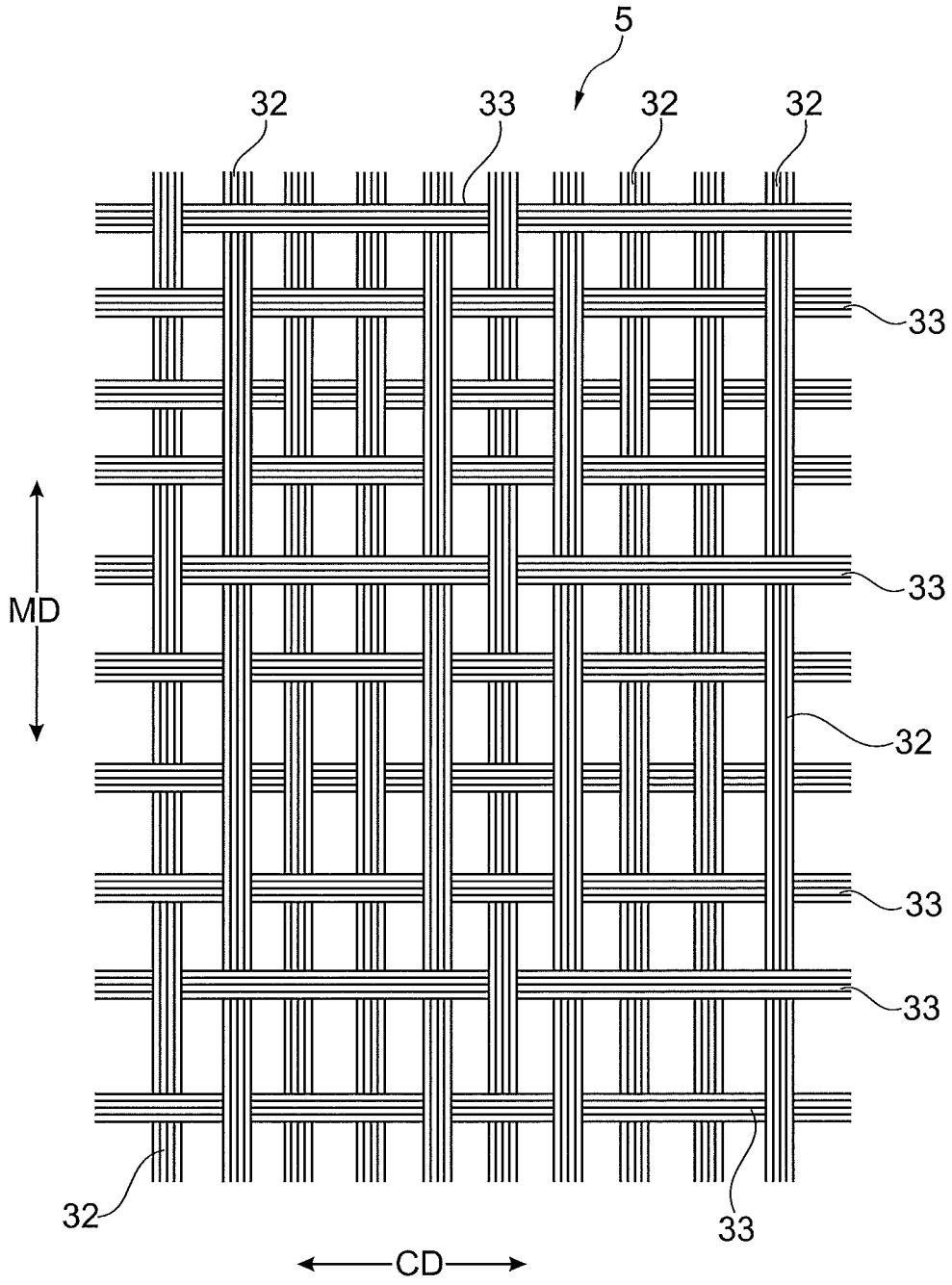
FIG. 6 shows schematically and from above, a first embodiment of a belt for use in the present invention.

An embodiment of a permeable flexible belt 5 is showed in FIG. 6. The flexible belt 5 which is showed in FIG. 6 is a woven fabric with a plurality of warp yarns 32 that extend in the machine direction (the MD direction in FIG. 6) and a plurality of weft yarns 33 that extend in a cross machine direction (the CD direction in FIG. 6) and that are interwoven with the plurality of warp yarns 32. At least some of the yarns 32, 33 are electrically conductive. Preferably, it is some of the weft yarns 33 (i.e. the yarns that extend in the cross machine direction) that are electrically conductive. Suitably, every fourth weft yarn or every fifth weft yarn 33 is electrically conductive. However, it is also conceivable that every second weft yarn 33 is electrically conductive or that all weft yarns 33 are electrically conductive. Embodiments are also conceivable in which one or several warp yarns 32 that extend in the machine direction are electrically conductive. It should be understood that the flexible belt 5 of FIG. 6 is permeable to air such that a suction device (for example a suction roll) or a blow box may act through the flexible belt to suck a paper web against the flexible belt 5.

An example of a fabric belt with electrically conductive yarns is disclosed in U.S. Pat. No. 6,790,796 and a fabric substantially according to that patent could conceivably be used as a flexible belt in a reel-up according to the present invention.

Figure 7:
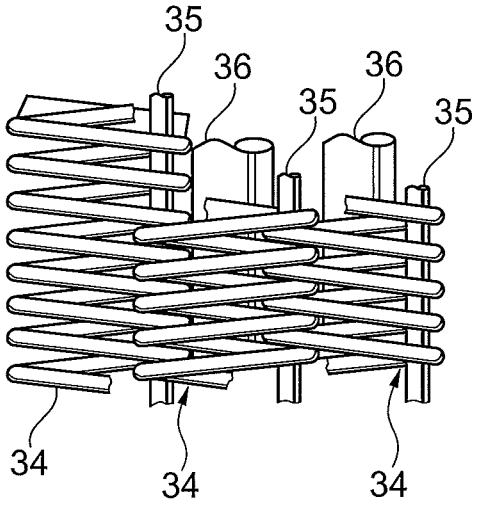
FIG. 7 shows, schematically and from above, a second embodiment of a belt for use in the present invention.
Figure 8:
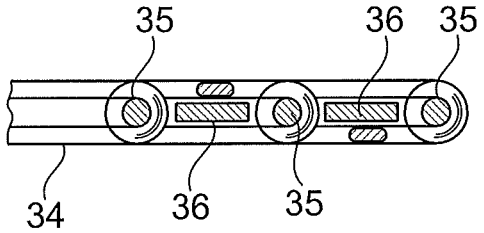
FIG. 8 is a side view of the belt of FIG. 7.

Yet another possible embodiment of a suitable flexible belt 5 is shown in FIG. 7 and in FIG. 8. The spiral link belt may have a structure which is of a kind substantially as disclosed in WO 2008/157223 A1. The spiral link belt 5 in FIG. 7 and FIG. 8 may comprise spiral coils 34 that are interconnected by a series of parallel pins 35. Electrically conductive elements 36 have been inserted into the spiral link belt and extend in a cross-machine direction. It should be understood that the flexible belt 5 of FIG. 7 and FIG. 8 is permeable to air such that a suction device (for example a suction roll) or a blow box may act through the flexible belt to suck a paper web against the flexible belt 5.

The function of the inventive reel-up 2 will now be explained further with reference to the drawings.

With reference to FIG. 1, it can be seen that in advantageous embodiments of the invention, the reel-up 2 may optionally comprise a deflection sensor 6 mounted adjacent to the flexible belt 5 and being arranged to measure the amount of deflection of the flexible belt 5 from the predetermined path of travel. In principle, the flexible belt 5 will be deflected during winding by an amount relative to the amount of paper material wound on the reel spool 4 (i.e. by an amount relative to the growing diameter of the paper roll 3 that is being formed on the reel spool 4) but the deflection can be kept constant or within predetermined limits if the distance between the reel spool 4 and the path of travel of the flexible belt is adjusted as the paper roll 3 grows. The reel spool 4 may be resting in carriages 9, preferably one carriage 9 at each side of the machine (i.e. at each axial end of a reel spool 4). The reel-up 2 may also comprise an actuator 7 for positioning the reel spool 4 and the flexible belt 5 relative to each other to vary the amount of deflection of the flexible belt 5 and a controller 8 connected to the deflection sensor 6 and the actuator 7 for controlling the amount of deflection of the flexible belt 5 as the paper roll 3 increases in diameter. The function of such an arrangement has been described in detail in U.S. Pat. No. 5,901,918 and exactly the same control method may be applied for the present invention. The basic principle is that, as the diameter of the paper roll 3 increases, the paper roll 3 will deflect the flexible belt 5 from its path of travel and in FIG. 1, the amount of deflection is indicated by "D". The deflection is detected by the deflection sensor 6 which may be a laser sensor. The detected deflection D generates a signal that is transmitted to a controller 8 that may be, for example, a computer. The controller 8 is programmed to keep the deflection D at a predetermined level or within predetermined limits. When actual deflection D deviates from the predetermined value or range, the controller 8 causes the actuator 7 to act to adjust the positioning of the reel spool 4 and the flexible belt 5 relative to each other. This can be done by, for example, causing the actuator 7 to move the reel spool 4 along rails 20 (see FIG. 2) away from the flexible belt 5 until the deflection D of the flexible belt 5 has reached an acceptable value. In this way, the pressure in the contact point C between the flexible belt 5 and the paper roll 3 can be controlled.

The use of a deflection sensor 6 and the controller 8 is very advantageous but embodiments are also conceivable in which these elements are not used.

With reference to FIG. 2, it can be seen that the reel-up 2 may be a part of a paper making machine 1 that comprises a drying cylinder 17 which may be a Yankee cylinder from which the paper web is creped by a doctor 27 as is known in the art. The Yankee cylinder may internally heated by steam and can be a Yankee cylinder of cast iron or it could be a Yankee cylinder of welded steel. The paper web W that has been creped from the hot surface of the drying cylinder 17 may optionally be passed through a calendar 24 and/or a measurement device 23 that is arranged to measure such properties as, for example, basis weight or dry solids content. In the embodiment of FIG. 2, the paper web W is then passed in an open draw to the flexible belt 5 of the reel-up 2. The reference numeral 16 indicates a guide roll that is used to guide the paper web. The web reaches the flexible belt 5 at a point of contact P that is located at the end of the open draw. Where the web W meets the flexible belt 5, a wedge-shaped space WS may result.

As can be seen in FIG. 2, the flexible belt 5 may be guided in its loop by internal guide rolls 10, 12, 13, 14 and optionally also by one or several external guide rolls 15.

In FIG. 2, it can also be seen that the reel-up 2 may comprise a stand supported by substantially vertical pillars 18. The pillars 18 may support parallel lower support beams 19 that carry rails 20 on which rails the carriage 9 of the reel spool 4 may be carried. The pillars 18 also support upper parallel beams 21 with rails 22 on which new reel spools 4 may be supported. The upper rail 22 may thus serve to store new reel spools 4. When a new paper roll 3 has been completely wound on its reel spool 4, a new reel spool 4 can be taken from the upper rail 22 as is known in the art.

In FIG. 2, it can also be seen that a source of underpressure 11 such as a blow box or a suction box can be placed inside the loop of the flexible belt 5. It should be understood that one or several sources of underpressure 11 may be used. For example, there could be one, two or three blow boxes placed after each other in the machine direction. There could also be more than three blow boxes (or suction boxes) inside the loop of the flexible belt 5. Instead of blow boxes or suction boxes, suction rolls may be used. Blow boxes and/or suction boxes may also be used in combination with one or several suction rolls to act through the flexible belt 5 (which is then permeable to air).

Figure 3:
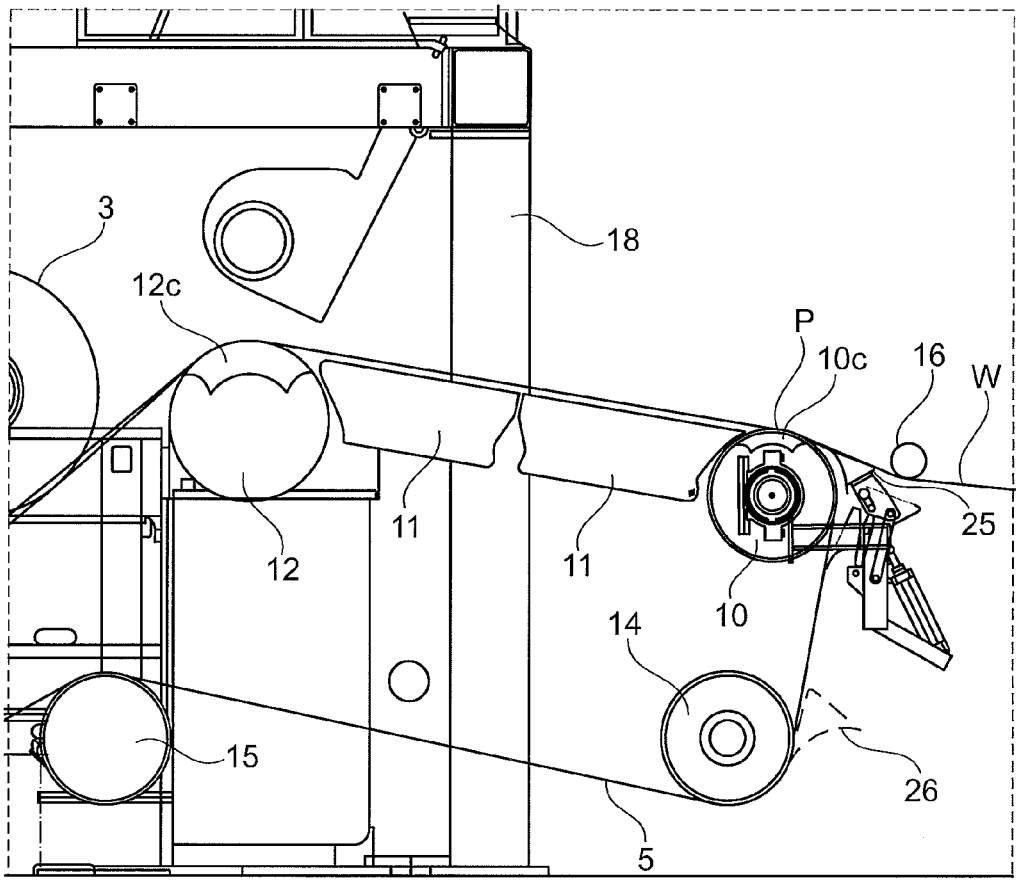
FIG. 3 is a side view similar to FIG. 2 but in larger scale and showing some details in one embodiment of the present invention.

Reference will now be made to FIG. 3. In FIG. 3, it can be seen that, at the contact point P where the paper web W meets the flexible belt 5, the guide roll 10 for the flexible belt 5 is a suction roll 10 with a suction zone 10*c* which is located in the area of the contact point P. By means of underpressure in the suction roll 10, the paper web will be caused to adhere to the flexible belt 5 when the flexible belt 5 is air permeable. The suction zone 10*c* of the roll 10 will also assist in removing air that has been entrained by the web or the flexible belt into the wedge-shaped space or gap WS between the web W and the flexible belt 5. In FIG. 3, it can also be seen that the guide roll 12 that precedes the point where the paper roll 4 meets the flexible belt 5 may also be a suction roll and that it has a suction zone 12*c*. With reference to FIG. 3, it can also be seen how an air deflector 25 may be placed in or adjacent the wedge-shaped gap WS to prevent boundary layer air entrained by the paper web W or the flexible belt 5 to come between the paper web W and the flexible belt 5. Such an air deflector 25 may be advantageous but is optional for the present invention. Embodiments without such an air deflector are possible. If such an air deflector 25 is used, it may be arranged such that it can be withdrawn from an active position and placed in an inactive position away from the wedge-shaped gap WS. To achieve this functionality, the air deflector 25 may be mounted on a holder which can be moved away from the wedge-shaped gap (or towards the wedge-shaped gap) by one or several hydraulic or pneumatic cylinder or some other actuator.

With reference to FIG. 3, it can also be seen how an additional air deflector 26 may be placed adjacent the flexible belt 5 at a point which is located at a distance from the contact point P where the paper web W meets the flexible belt 5. This additional air deflector 26 is entirely optional. If such an additional air deflector 26 is used, it may serve to divert boundary layer air away from the flexible belt 5 and cause a flow of air in a desired direction. Such a flow of air can be used to carry dust away from the area of the reel-up.

It should be understood that the guide rolls 10, 12 do not necessarily have to be suction rolls, they could also be solid rolls. The guide roll 10 in FIG. 2 and FIG. 3 could also be a roll which has a suction zone only at an axial end of the roll but which is otherwise a solid roll. A suction zone that is located only at the axial end of the roll 10 could be useful for tail threading.

When the flexible belt is permeable to air, sources of underpressure such as suction rolls 10, 12, suction boxes or blow boxes 11 can act through the flexible belt 5 such that the paper web will be caused to adhere to the flexible belt 5. Experience has showed that such an arrangement produces a reliable adherence of the paper web W to the belt. When static electricity in the belt is dissipated away from the belt since the belt is electrically conductive, static electricity is less likely to cause unpredictable fluctuations in the adherence of the web to the flexible belt.

When the flexible belt is a woven fabric with electrically conductive yarns as shown in FIG. 6, the electrically conductive yarns will cause static electricity to dissipate away from the flexible belt 5 and from the paper web W which is in contact with the flexible belt 5.

When the flexible belt 5 is a spiral link belt as shown in FIG. 7, the electrically conductive elements 36 will cause static electricity in the flexible belt 5 and the paper web W to be dissipated.

When static electricity is dissipated away from the belt, this also reduces the risk that sudden discharges of electrical energy will cause disturbances in the operation of the deflection sensor 6, the controller 8 and the actuator 7 since such equipment may comprise electronic components that may be affected by electrical discharges. Therefore, the use of a flexible belt that is electrically conductive contributes to a more reliable operation of those components. As a result, the control of the winding operation is improved. This result is achieved independently of the improved control of web adherence that is also achieved.

Figure 4:
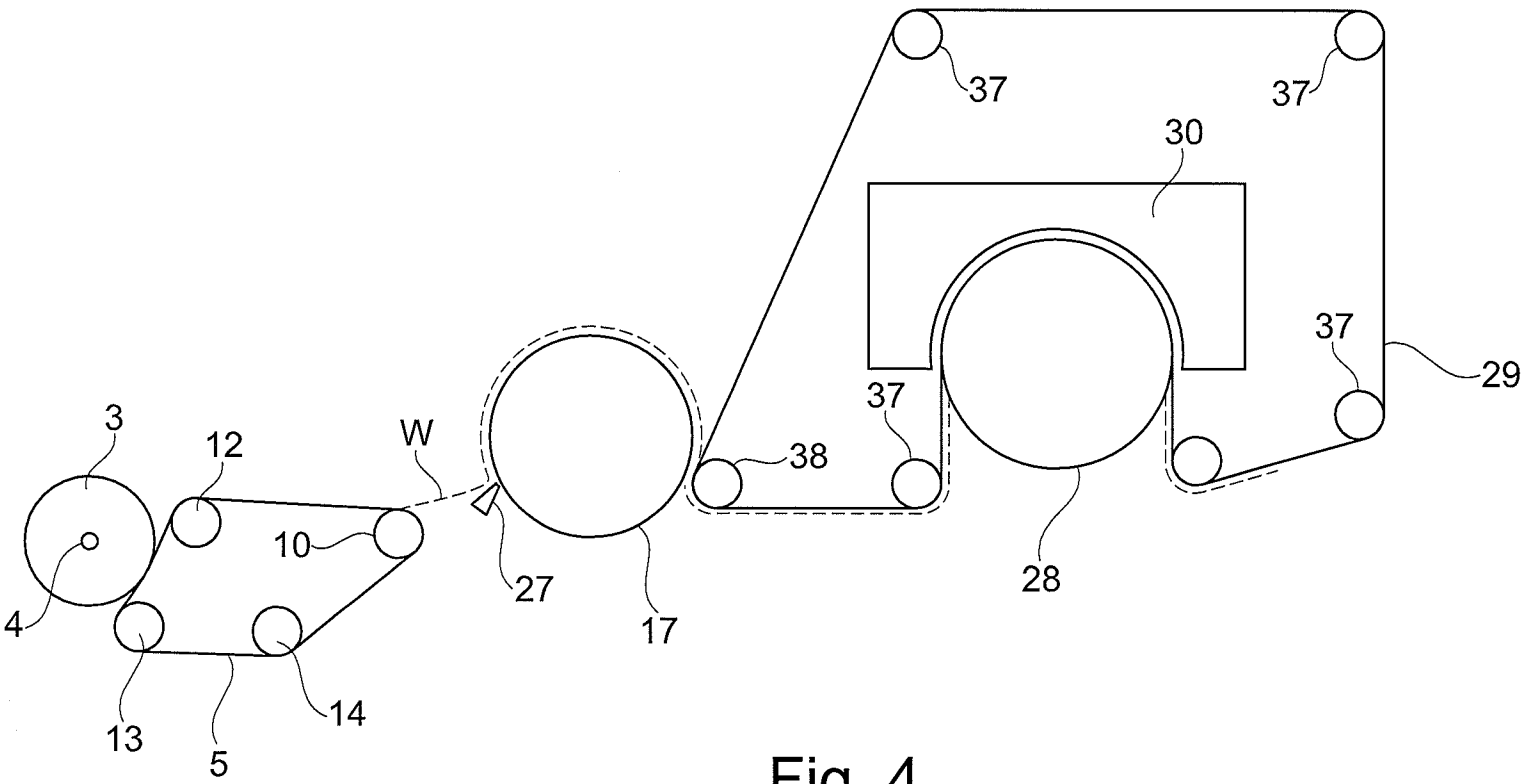
FIG. 4 is a schematic side view of a part of a paper machine with a different layout and in which the inventive reel-up could be used.

With reference to FIG. 4, it can be seen that the inventive reel-up may also be used in a paper making machine where a Yankee drying cylinder is preceded by a through air drying cylinder 28, i.e. a TAD cylinder 28. In the configuration of FIG. 4, a TAD wire 29 is arranged to carry the web W over the TAD cylinder 28 and the TAD wire 29 is guided by guide rolls 37. A press roll 38 arranged within the loop of the TAD wire 29 forms a nip with the Yankee cylinder 17. The nip formed by the press roll 38 and the Yankee cylinder 17 functions as a transfer nip in which the paper web W (especially a tissue paper web) is transferred to the Yankee cylinder 17. The TAD cylinder 28 may have a hood 30. Hot air used to dry a tissue paper web may by created by (for example) a burner (not showed in FIG. 4) and a fan (not showed in the figure) may be used to force the hot air into the hood 30. The hot air is drawn through the web carried on the wire 29 and through the cylinder 28.

Figure 5:
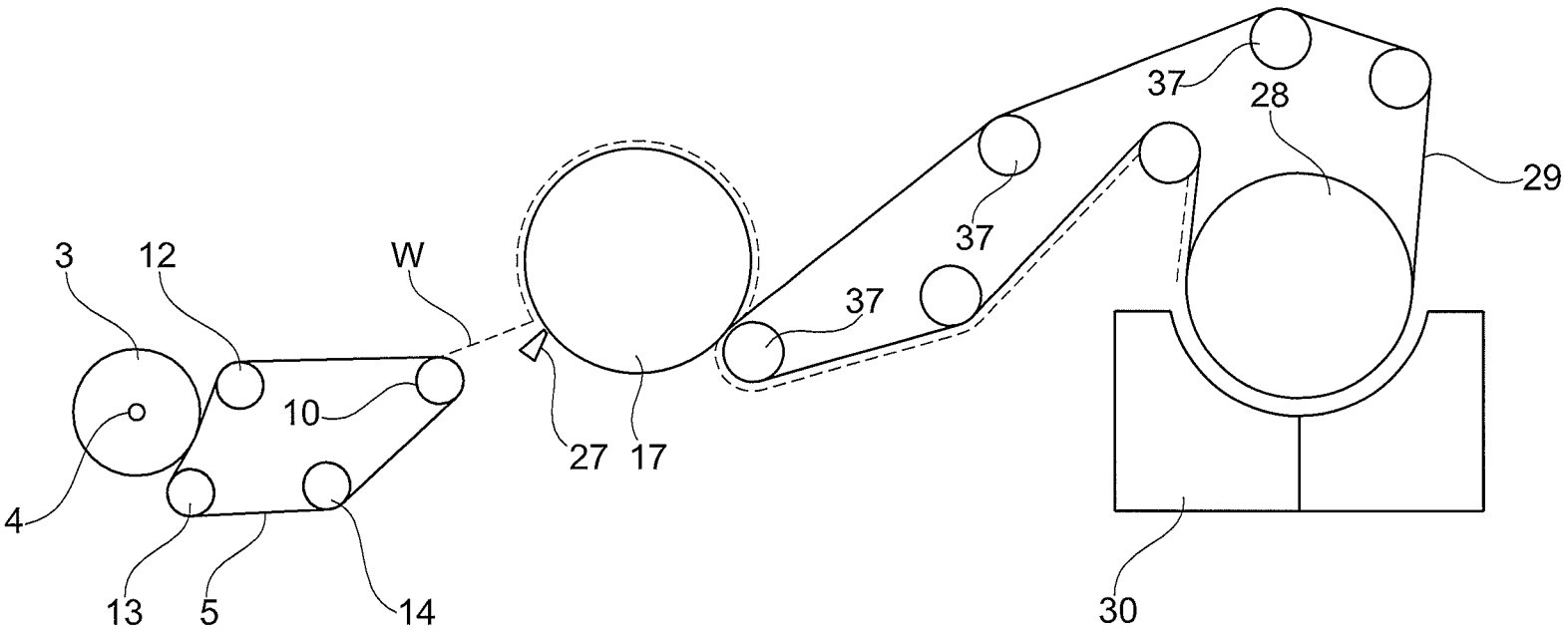
FIG. 5 is a schematic side view similar to FIG. 5 but with an alternative layout.

A machine substantially similar to the machine of FIG. 4 is showed in FIG. 5. The machine according to FIG. 5 differs from the machine according to FIG. 4 in that the TAD cylinder 28 is placed in a different position.

When a through air drying cylinder 28 is used, the hot air does not necessarily have to flow from the hood 30 to the TAD cylinder 28. Instead, it could also be so that the hot air flows from the TAD cylinder 28, through the tissue paper web and into the hood 30.

It should be understood that, in both the configuration of FIG. 2, the configuration of FIG. 4 and in the configuration of FIG. 5, there is a forming section which is not showed.

It will now be understood that the inventive method of winding a paper web W to a paper roll comprises the steps of engaging an endless flexible belt 5 against a reel spool 4 and moving the endless flexible belt 5 along a predetermined path of travel. The reel spool 4 is rotated such that the surface of the reel spool 4 moves together with the flexible belt 5 and forms a nip with the flexible belt 5. The paper web W is advanced into the nip and directed around the reel spool 4 to form a roll 3 of increasing diameter. Since the endless flexible belt 5 comprises electrically conductive material, static electricity in the endless flexible belt 5 is dissipated away from the endless flexible belt 5. In FIG. 1, the nip can be represented by the point of contact C between the flexible belt 5 and the paper roll 3.

Embodiments are conceivable in which the paper web is produced entirely without creping, for example if the only drying cylinder that is used is a through air drying cylinder. However, the invention is especially valuable in such cases where the paper web W has first been creped from a Yankee drying cylinder 17 and subsequently conveyed to the endless flexible belt 5 to be wound to a roll 3 since creping produces much dust and the use of static inductors is more difficult in such circumstances.

It should be understood that, when static electricity is dissipated away from the flexible belt 5 by means of electrically conductive materials or elements in the flexible belt 5, this will also cause static electricity to be dissipated away from the paper web W since the paper web W is in contact with the flexible belt 5. Static electricity in the flexible belt 5 will of course be discharged to ground when the flexible belt 5 comes into contact with metal objects such as rolls that are journalled in the frame of the paper making machine.

The use of a flexible belt 5 that comprises or is made of electrically conductive material can thus give a more stable and predictable adherence of the paper web to the flexible belt. This is especially the case when the flexible belt is permeable to air and sources of underpressure have been placed within the loop of the flexible belt (i.e. when at least one source of underpressure has been placed within the loop of the flexible belt 5 and adjacent the flexible belt 5 such that it can act through the flexible belt 5).

Independently of the adherence of the paper web to the flexible belt, the use of a flexible belt which comprises electrically conductive material also leads to a more reliable winding when a deflection sensor and a controller is used to control an actuator that is arranged to move the reel spool relative to the flexible belt.

The invention is particularly useful in such cases where the moisture content (water content) of the paper web that arrives to the belt reel-up is in the range of 2%-5% and especially when the moisture content is in the range of 2%-3%. In practice, the moisture content of the web will not be lower than 1% by weight. It can therefore be said that the invention is particularly useful in such cases where the paper web that arrives to the reel-up has a moisture content in the range of 1% by weight-5% by weight and especially when the paper web has a moisture content in the range of 2% v-3%. For paper webs with a moisture content higher than about 5%, static electricity will normally not be generated to any substantial amount.

Although the invention has been described above in terms of, a reel-up, a machine comprising the reel-up and a method of winding, it should be understood that these categories only reflect different aspects of one and the same invention. The inventive method may thus comprise such steps that would be the inevitable result of using the inventive reel-up and/or the inventive machine that comprises the inventive reel-up, regardless of whether such steps have been explicitly mentioned or not.

The invention claimed is:

1. A method of winding a paper web (W) to form a roll (3), the method comprising the steps of:

engaging an endless flexible belt (5) against a reel spool (4);

moving the endless flexible belt (5) along a predetermined path of travel; rotating the reel spool (4) such that the surface of the reel spool (4) moves together with the flexible belt (5) and forms a nip with the flexible belt (5); and advancing the paper web (W) into the nip and directing the web (W) around the reel spool (4) to form a roll (3) of increasing diameter, wherein the endless flexible belt (5) is at least one of:

an air permeable woven fabric with a plurality of warp yarns (32) and a plurality of weft yarns (33) interwoven with the plurality of warp yarns (32), at least some of the yarns (32, 33) being electrically conductive such that static electricity in the flexible belt (5) is dissipated away from the flexible belt (5); or an air permeable spiral link belt which comprises electrically conductive elements (36) that have been inserted into the spiral link belt and extend in a cross-machine direction such that static electricity in the flexible belt (5) is dissipated away from the flexible belt.

2. A method according to claim 1, wherein:

the paper web (W) is first creped from a Yankee drying cylinder (17) and subsequently conveyed to the endless flexible belt (5) to be wound to a roll (3); and the paper web (W) that arrives to the reel-up (2) has a moisture content of 1% by weight –5% by weight.

3. A reel-up (2) for receiving and winding into a roll (3) a paper web (W) that arrives from a drying cylinder (17) in a paper making machine (1), the reel-up (2) comprising:

a rotatably mounted reel spool (4) onto which a paper web (W) can be wound to create a paper roll (3) of increasing diameter; and an endless flexible belt (5) mounted for rotation along a predetermined path of travel such that the flexible belt (5) forms a loop, wherein:

the flexible belt (5) is positioned adjacent to the reel spool (4) to engage the paper web (W) against the reel spool (4) during winding such that the flexible belt (5) is deflected from the predetermined path of travel when the paper roll (3) starts to build up on the reel spool (4), the endless flexible belt (5) is at least one of:

an air permeable woven fabric comprising a plurality of warp yarns (32) and a plurality of weft yarns (33) interwoven with the plurality of warp yarns (32), at least some of the yarns (32, 33) being electrically conductive such that static electricity in the flexible belt (5) is dissipated away from the flexible belt (5); or an air permeable spiral link belt comprising electrically conductive elements (36) that have been inserted into the spiral link belt and extend in a cross-machine direction such that static electricity in the flexible belt (5) is dissipated away from the flexible belt.

4. A reel-up according to claim 3, wherein:

the flexible belt (5) is an air permeable woven fabric with a plurality of warp yarns (32) and a plurality of weft yarns (33) interwoven with the plurality of warp yarns (32); and at least some of the weft yarns (33) are electrically conductive.

5. A reel-up according to claim 3, wherein the flexible belt (5) is an air permeable spiral link belt which comprises electrically conductive elements (36) that have been inserted into the spiral link belt and extend in a cross-machine direction.

6. A reel-up according to claim 3, wherein the reel-up (2) further comprises:

a deflection sensor (6) mounted adjacent to the flexible belt (5) and being arranged to measure the amount of deflection of the flexible belt (5) from the predetermined path of travel; an actuator (7) for positioning the reel spool (4) and the flexible belt (5) relative to each other to vary the amount of deflection of the flexible belt (5); and a controller (8) connected to the deflection sensor (6) and the actuator (7) for controlling the amount of deflection of the flexible belt (5) as the paper roll (3) increases in diameter.

7. A reel-up according to claim 3, wherein the reel-up (2) further comprises at least one source of underpressure (10, 11, 12) located inside the loop of the flexible belt (5).

8. A paper making machine for making tissue paper, said paper making machine comprising:

a Yankee drying cylinder (17); and a doctor blade (27) arranged to crepe a paper web from the surface of the Yankee drying cylinder (17), wherein, downstream of the Yankee drying cylinder (17), the paper making machine further comprises a reel-up (2) according to claim 3.

* * * * *